US006889843B1

(12) United States Patent
Longhurst et al.

(10) Patent No.: US 6,889,843 B1
(45) Date of Patent: May 10, 2005

(54) APPARATUS AND METHODS FOR CONTROLLING THE SEPARATION OF PARTICULATE MATERIAL

(75) Inventors: Donald A. Longhurst, Kennesaw, GA (US); Franz-Josef Zurhove, Bad Iburg (DE)

(73) Assignee: Polysius Corp., Atlanta, GA (US)

( * ) Notice: Subject to any disclaimer, the term of this patent is extended or adjusted under 35 U.S.C. 154(b) by 388 days.

(21) Appl. No.: 09/678,045

(22) Filed: Oct. 3, 2000

(51) Int. Cl.[7] ..... B07B 7/00

(52) U.S. Cl. ..... 209/135; 209/137; 209/139.1; 209/143; 209/154

(58) Field of Search ..... 209/20, 132–137, 209/138, 139.1, 142, 143, 154

(56) References Cited

U.S. PATENT DOCUMENTS

| | | | | |
|---|---|---|---|---|
| 717,971 A | | 1/1903 | Colvin | |
| 1,530,277 A | | 3/1925 | Mettler | |
| 2,147,911 A | | 2/1939 | Menk | |
| 4,853,112 A | * | 8/1989 | Brown | 209/135 X |
| 4,865,721 A | * | 9/1989 | Smith et al. | 209/135 |
| 5,392,998 A | | 2/1995 | Suessegger et al. | |
| 5,794,786 A | * | 8/1998 | Arai et al. | 209/139.1 X |

FOREIGN PATENT DOCUMENTS

| | | |
|---|---|---|
| DE | 354995 | 6/1922 |
| DE | 626782 | 3/1936 |
| DE | 1 224 130 | 9/1966 |
| DE | 32 45 942 A1 | 7/1984 |
| DE | 39 04 697 C2 | 8/1990 |
| DE | 196 48 841 A | 5/1998 |
| GB | 413294 | 7/1934 |

* cited by examiner

*Primary Examiner*—Donald P. Walsh
*Assistant Examiner*—Tuan Nguyen
(74) *Attorney, Agent, or Firm*—John K. McCulloch

(57) ABSTRACT

Apparatus and methods for separating particulate material into relatively fine and relatively coarse particles wherein such particulate material is introduced to a separating zone through which a gas stream flows at such volume and velocity as to entrain fine particles and convey them from the separating zone to grinding or other facilities and wherein the fineness of entrained particles may be adjusted by diverting a selected portion of the gas stream from the separating zone to a bypass passageway followed by recombining the diverted portion of such gas stream with the gas containing the entrained particles.

16 Claims, 3 Drawing Sheets

APPARATUS AND METHODS FOR CONTROLLING THE SEPARATION OF PARTICULATE MATERIAL

This invention relates to apparatus and methods, especially useful in the manufacture of cement, for controlling the separation of particulate material into relatively fine and relatively coarse particles.

BACKGROUND OF THE INVENTION

In the manufacture of granular materials such as cement it is conventional to introduce comminuted particulate material to a sifter or separator having a separating zone in which the particulate material is reduced to relatively fine and relatively coarse particles. A gas stream flows through the separating zone at such velocity as to entrain relatively fine particles and convey them downstream of the separating zone for storage or further processing. The coarse particles which are not entrained in the gas stream are discharged from the separating zone for further comminution or other treatment. The fine particles which are entrained in the gas stream conventionally are separated from the gas downstream of the separating zone.

The separation of the gas and fine particles conventionally occurs in a cyclone separator in which the gas and the particles flow out of the separator along different paths. The efficiency of such separators depends in large part upon the volume and rate of flow of the gas. Any reduction in the volume of such gas could affect adversely the separation of the particles from the gas.

The treatment to which the relatively fine particles downstream of the separating zone may be subjected depends in large measure on the size or fineness of the relatively fine particles entrained by the gas stream. The fineness of such particles may be regulated by the volume and velocity of the gas stream that passes through the separating zone. However, and as is indicated above, changes in the volume and velocity of the gas stream affect the efficiency of the gas/fine particle separation. Reductions in the efficiency of the gas/fine particle separation can have adverse consequences on the further treatment of the particles downstream of such separation.

In some instances the gas stream that is introduced to the separating zone may be heated for the purpose of drying or preheating the particles. In other instances, the gas may be cooled for the purpose of cooling the particles. In either instance a reduction in the volume of air which is used to transport entrained fine particles to the gas/fine particle separator may have adverse consequences on the dryness or temperature of the fine particles.

A principal object of the invention is to provide apparatus and methods which overcome the undesirable effects referred to above.

SUMMARY OF THE INVENTION

Particulate material of the kind with which the invention is concerned is delivered from a source to a comminution zone at which the material is crushed to form relatively coarse and relatively fine particles. The crushed material is delivered to a separator having a separating zone in which the material is separated into relatively coarse and relatively fine particles. A gas stream is introduced to the separator independently of the material and passes through the separating zone at such velocity as to entrain fine particles and convey them from the separator to a gas/particle separator at which the particles are separated from the gas and conveyed to a collection bin for storage or subsequent treatment. The gas separated from the coarse particles preferably is returned from the gas/particle separator to the separating zone for further separation of relatively coarse and fine particles.

In accordance with the invention a gas passageway is provided for enabling a selected portion of the gas stream presented to the separator to bypass the separating zone following which such portion of the gas stream is recombined with the gas and the entrained fine particles. In one embodiment the bypass comprises a passageway within the particle separator housing and is so positioned that material enroute to the separating zone passes through the diverted portion of the gas. In another embodiment the passageway is external of the separator, but is in communication with both the gas inlet and the outlet through which gas and entrained fine particles pass.

One or more dampers are provided in the bypass passageway for controlling the admission of gas to the bypass passageway. The position of the dampers can be adjusted in such manner as to control the fineness of particles entrained in the gas stream and such control can be regulated in response to changes in the weight of fine particles contained in the collection bin which is downstream from the gas/particle separator.

THE DRAWINGS

Apparatus constructed in accordance with presently preferred embodiments of the invention are illustrated in the accompanying drawings in which.

DETAILED DESCRIPTION

Figure 1:
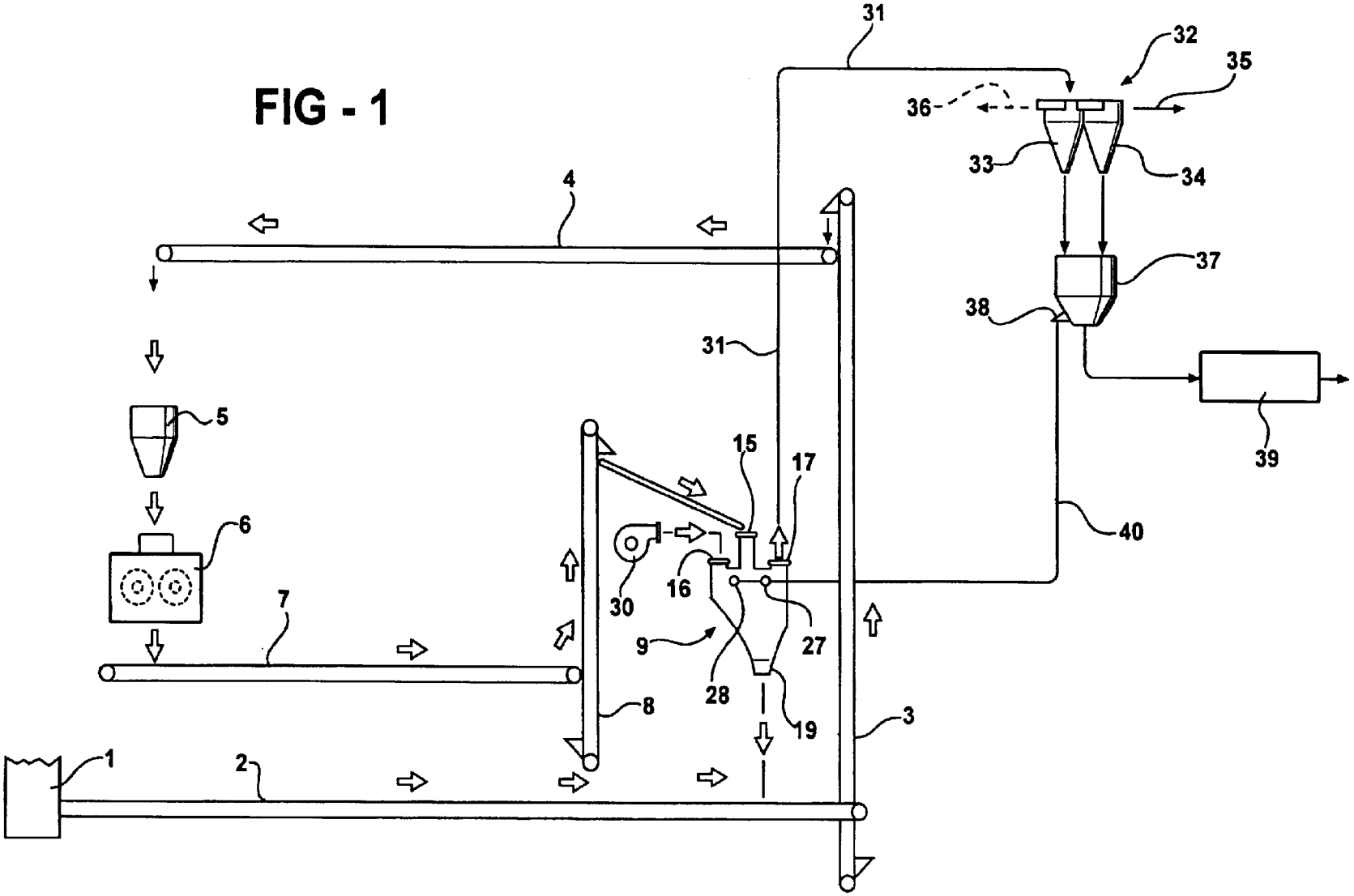
FIG. 1 is a diagrammatic flow sheet illustrating the apparatus and the method of its operation.

Apparatus constructed in accordance with the invention is disclosed as forming part of an otherwise conventional cement production facility wherein particulate material from a silo or other source 1 is delivered by a conveyor 2 to a bucket elevator 3 which discharges the particulate material to a conveyor 4 that supplies a hopper 5. From the hopper the material is delivered to a high pressure, roller comminuting zone 6 at which the material is crushed in known manner and delivered to a conveyor 7 that conveys such material to an elevator 8 from which the material is discharged to a separator 9 constructed in accordance with the invention.

Figure 3:
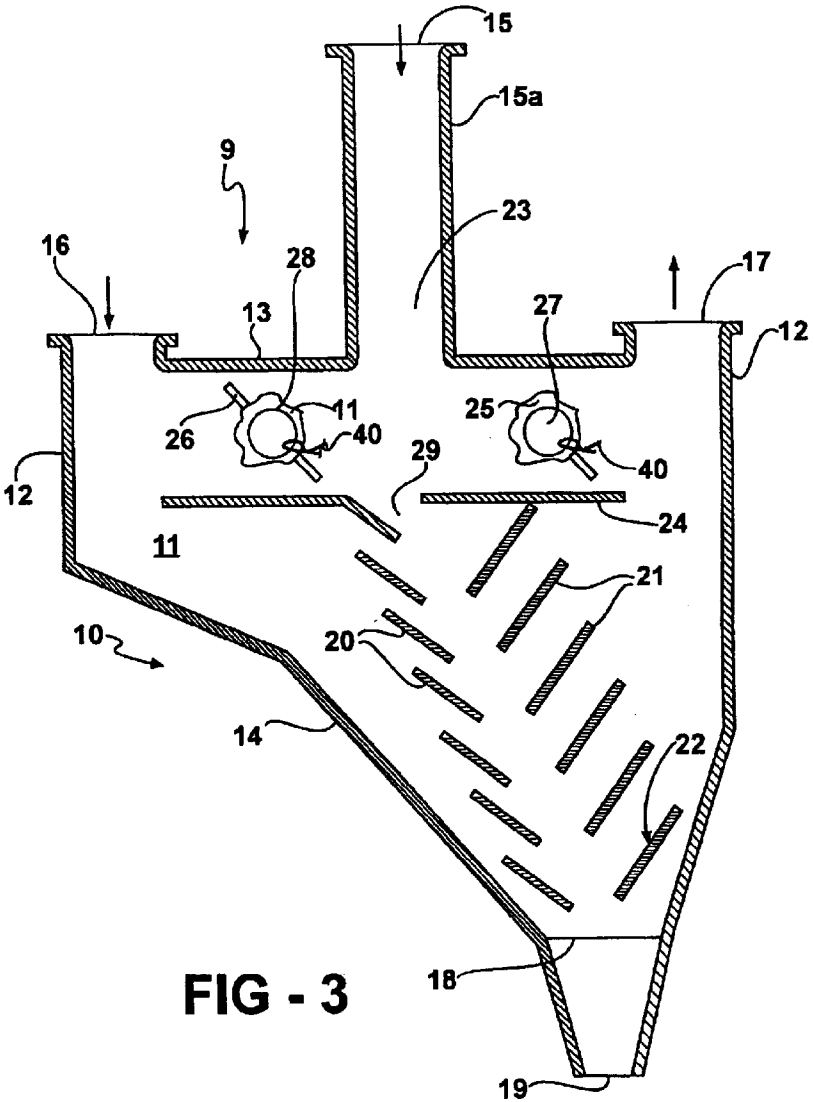
FIG. 3 is a vertical sectional view of the separator shown in FIG. 2.
Figure 2:
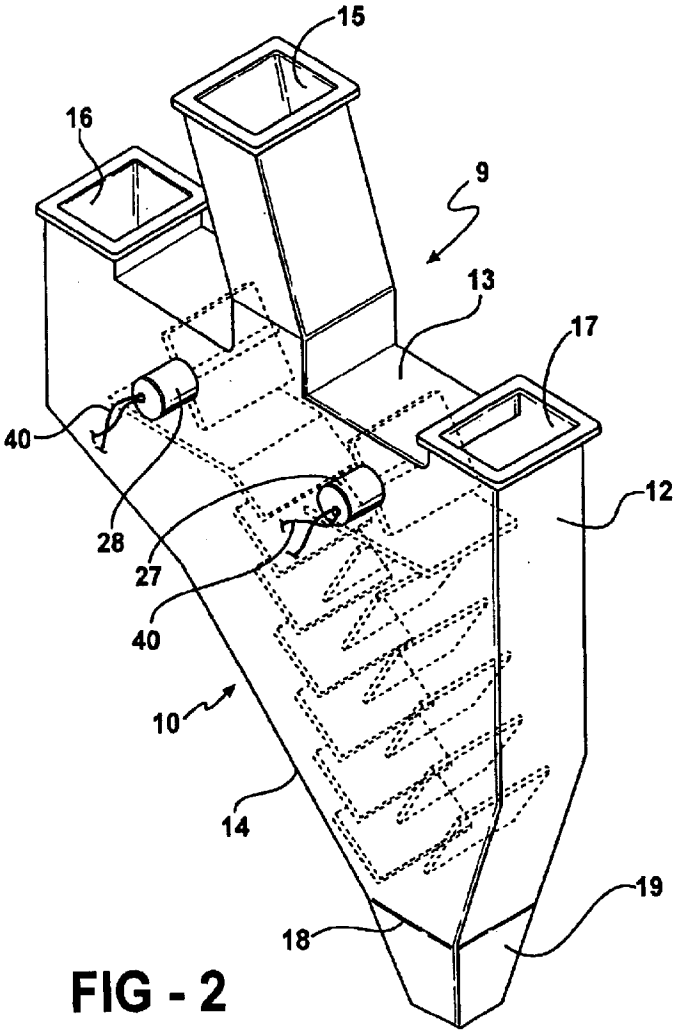
FIG. 2 is a diagrammatic, isometric view of one embodiment of the separator.

One embodiment of the separator 9 is shown in FIGS. 2 and 3 and comprises a housing 10 having opposed side walls 11, opposed end walls 12, a top wall or cover 13 and an inclined bottom wall 14. The cover 13 has three openings therein. One opening 15 is near the center of the cover and has an upwardly extending chute 15*a* connected thereto. The other openings 16 and 17 are adjacent opposite ends of the cover for reasons to be explained in more detail hereinafter. The opening 15 is an inlet for particulate material delivered from the comminuting zone 6, the opening 16 is a gas inlet, and the opening 17 is an outlet for fine particles and gas. At the bottom of the housing 9 is an opening 18 to which is fitted a conical chute 19 through which coarse particles may be discharged.

The walls of the housing 9 form a chamber within which are two vertical ranks of inclined vanes 20 and 21 which are supported by the side walls 11 and are in chevron form so that particulate material introduced to the housing 10 will cascade downwardly and be reduced to relatively fine and relatively coarse particles. The area in which the vanes 20 and 21 are positioned forms a separating zone 22 in which downwardly cascading particulate material is separated into the relatively coarse and the relatively fine particles.

At a level above that of the separating zone 22 is a passageway 23 formed by a partition or wall 24 which spans the width of the side walls 11 and parallels the cover 13. Within the passageway 23 are two spaced apart dampers 25 and 26. Each damper is rotatable about a horizontal axis and each damper is of such dimensions as selectively to close and open the passageway. Connected to the damper 25 is a rotary control or actuator 27. A similar control 28 is coupled to the damper 26. The controls 27 and 28 may be coupled to one another in known manner for conjoint operation.

As is best shown in FIG. 3, the partition 24 has an opening 29 aligned with the material inlet 15. Such opening enables material which enters the material inlet 15 to pass through the passageway 23 upstream of the separating zone 22 so that, in the event gas is flowing through the passageway, the incoming material may be preheated, precooled, or predried enroute to the separating zone 22.

Figure 5:
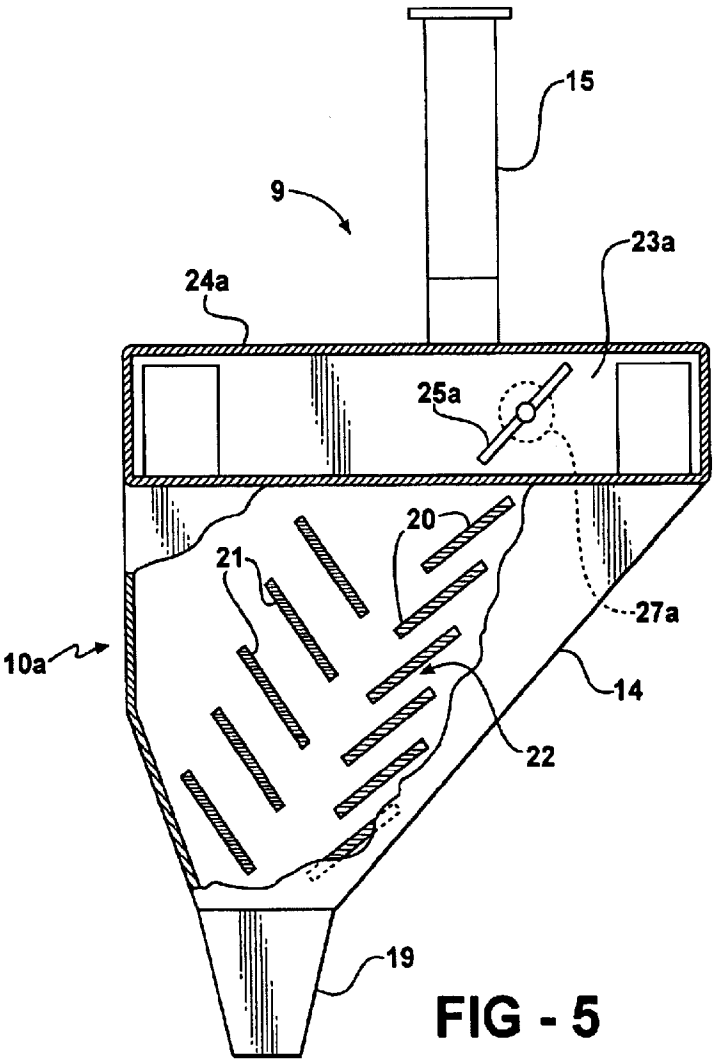
FIG. 5 is a vertical sectional view of the separator shown in FIG. 4.
Figure 4:
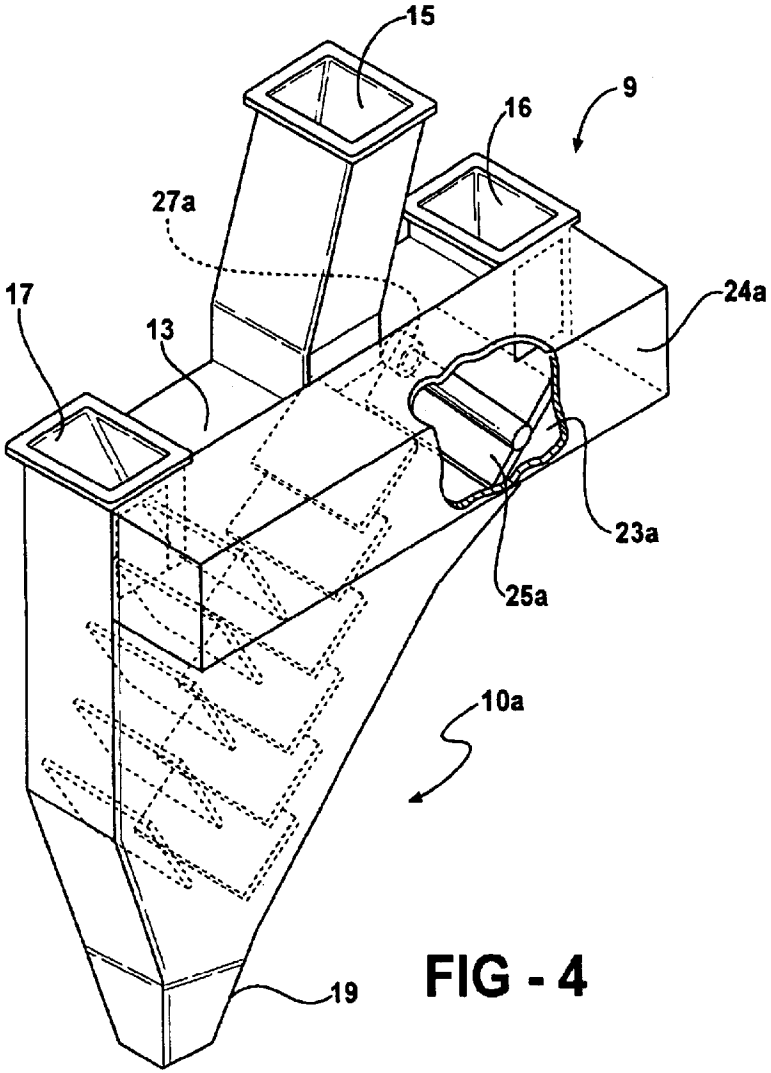
FIG. 4 is a diagrammatic, isometric view of a second embodiment of the separator but rotated 180° from the portion shown in FIG. 1.

The separator 9 disclosed in FIGS. 4 and 5 corresponds to that shown in FIGS. 2 and 3, but differs from the latter in that the passageway 23*a* is formed by a duct 24*a* which is external of the housing 10*a* and communicates by suitable connections at its opposite ends with the gas inlet 16 and the outlet 17, respectively. A single damper 25*a* is pivotally mounted in the passageway 23*a* adjacent the gas inlet end thereof. The damper 25*a* is movable to any selected one of a number of positions between its open and closed positions by a control 27*a*.

The method of operation of the apparatus described thus far is that raw material is conveyed from the silo 1 or other source via the conveyors 2, 3, and 4 to the hopper 5 and thence to the comminuting zone 6. The comminuted, particulate material is conveyed from the comminuting zone 6 via the conveyors 7 and 8 to the material inlet 15 of the separator 9.

At the same time a stream of gas from a source thereof is delivered independently of the material via a blower 30 to the gas inlet 16 of the separator 9. If the dampers 25 or 25*a* are closed, the gas stream will flow toward and through the separating zone 22 to and through the outlet 17 and into the conduit 31.

Material entering the separator 9 through the material inlet 15 independently of the gas stream flows downwardly by gravity through the separating zone 22 along a path leading to the coarse particle outlet 18. As the material flows downwardly it will be cascaded by the vanes 20 and 21 and reduced to relatively coarse and relatively fine particles.

The velocity of the gas flowing through the separating zone 22 should be such as to entrain fine particles of various sizes and convey them to and through the fine particle and gas outlet 17. Particles which are too coarse to be entrained in the gas stream will continue their downward movement and be discharged from the separator via the coarse particle outlet and chute 19. Such particles may be returned to the comminuting zone 6 by the elevator 3 and the conveyor 4 for further comminution.

The gas and entrained particles discharged through the outlet 17 are conveyed by the conduit 31 to a gas/particle separator 32 which, in the form shown, comprises a pair of cyclones 33 and 34 arranged in series. The gas from which the particles have been separated flows out of the cyclones via a line 35 for discharge to atmosphere or other apparatus or, if desired, partially may be recirculated to the gas inlet 16 by a line 36. A secondary fan (not shown) may communicate with the line 35 or 36 for supplying additional gas. If desired, either or both of such fans may be coupled to a source of gas, such as air, which may be cooled, heated, or at ambient temperature.

Particulate material from the gas/particle separator 32 flows to a collector or bin 37 which is supported by one or more load cells 38 of conventional construction and which are capable of sensing changes in weight of material in the bin. Material from the bin 37 may pass therefrom to a grinding mill 39 such as a ball mill, wherein the fine particulate material is subjected to grinding operations to reduce the particles to the desired fineness. Ground material passes from the mill 39 to a storage area or other suitable destination.

In the embodiment of the material separator 9 shown in FIGS. 2 and 3 the volume of gas admitted to the housing 10 via the gas inlet 16 should be sufficient to enable efficient operation of the gas/particle separator 32. The quantity and fineness of relatively fine particles that are entrained in the gas stream which flows through the separating zone 22 and through the outlet 17 to the bin 36 may be adjusted by diverting some portion of the gas stream entering the housing 10 from the separating zone 22. Bypassing the separating zone may be accomplished by moving the dampers 25 and 26 from their passageway-closing positions to selected adjusted positions in which the passageway 23 is at least partially open, thereby enabling a portion of the gas stream entering the housing 10 via the gas inlet 16 to be diverted into the passageway 23 for discharge through the outlet 17. In this embodiment two dampers 25 and 26 are desirable to ensure that gas which has passed through the separating zone 22 when the inlet end of the passageway 23 is closed does not enter the passageway 23 adjacent the outlet 17.

The volume of gas that is diverted from the separating zone 22 to the passageway 23 affects the fineness of the particles which may be entrained in the gas stream. For example, whenever a portion of the gas stream is diverted from the separating zone 22 the particles which may be entrained in that part of the gas stream which flows through the separating zone will be finer than in the case in which all of the gas stream flows through the separating zone. Consequently, the quantity and weight of particles delivered to the bin 37 following a diversion of a portion of the gas stream from the separating zone 22 will be less than that when all of the gas stream passes through the separating zone. Accordingly, the weight of the material in the bin 37 will be reduced, and the reduction in weight will be sensed by the sensor 38. The sensor thereupon will generate a signal which may be used to alert the system operator to adjust the positions of the dampers 25,26 so as to increase, decrease, or eliminate the diversion of the gas stream from the separating zone.

In most instances the sensor 38 will be set to be inactive as long as the weight of material in the bin 37 is at a fairly constant level. Once the sensor has been set, the rate of consumption of such material by the mill 39 may be used to control the fineness of the particles delivered to the bin. For example, if the particles delivered from the bin 37 to the mill 39 are of such fineness as to require minimum grinding by the mill, the throughput of the mill may be sufficiently great as to cause the weight of material in the bin to decrease. In this event the signals from the sensor 38 indicate that the diversion of gas from the separating zone 22 should be reduced, thus enabling more of the gas stream to pass through the separating zone so that a greater quantity of particles is delivered to the bin, thereby increasing the weight of material in the bin.

Conversely, if the weight of material in the bin 37 increases, this indicates that the quantity of materials supplied to the bin is greater than that which is being consumed by the mill. In this event the signal from the sensor may be used to signal the need to divert a selected portion of the gas stream from the separating zone 22, thereby resulting in a reduction in the fineness of particles delivered to the bin.

In the embodiment of the separator 9 shown in FIGS. 4 and 5, the operation is similar to that previously described. In this embodiment, however, the bypass passageway 23*a* is wholly external of the housing 10*a*. A selected portion of air entering the inlet 16 may be diverted into the bypass passageway 23*a* by adjustment of the damper 25*a* which is located adjacent the inlet 16. In this embodiment only one damper 25*a* is required since there are no openings in the passageway other than those which communicate with the inlet 16 and the outlet 17. The position of the damper 25*a* is controlled by an operator 27*a*.

The operation of the embodiment shown in

FIGS. 4 and 5 is quite similar to that of the earlier described embodiment. In this embodiment, however, none of the particulate material introduced to the housing 10*a* via the material inlet 15 passes through the passageway 23*a*.

In either of the disclosed embodiments the signals from the sensor 38 may be coupled electrically directly to the damper controls 27,27*a* in known manner. The coupling is indicated by the reference character 40.

In the operation of the invention utilizing either of the disclosed embodiments the volume and velocity of the gas stream introduced to the separator housing 10 or 10*a* will be sufficient to effect entrainment of relatively fine particles from the separating zone 22 and ensure efficient operation of the gas/particle separating apparatus 32. Even though a selected portion of the gas stream introduced to the separator housing may be diverted from the separating zone to the bypass passageway, such diverted gas is recombined with the gas in which the relatively fine particles are entrained conveyed to the gas/particle separator 32 via the conduit 31. As a consequence, the volume of gas that is delivered to the particle/gas separator 32 is sufficient to ensure efficient operation of the latter.

The disclosed embodiments are illustrative of presently preferred apparatus and methods according to the invention, but are intended to be illustrative rather than definitive thereof. The invention is defined in the claims.

We claim:

1. A separator construction for use in separating particulate material into relatively coarse and relatively fine particles, said construction comprising:

a separator housing having an upper end and a lower end;

means in said housing adjacent the upper end thereof forming a separating zone for reducing particulate material to relatively fine and relatively coarse particles;

particulate material inlet means for introducing particulate material to said separating zone;

gas inlet means independent of said particulate material inlet means in communication with the upper end of said housing for introducing a stream of gas into said separating zone for movement along a path at such velocity as to entrain fine particles;

a coarse particles outlet adjacent the lower end of said housing;

a gas and fine particles outlet in communication with the upper end of said housing;

means adjacent the upper end of said housing upstream of said separating zone forming a passageway between said gas inlet and said gas and fine particles outlet;

adjustable diverting means for diverting a selected portion of said gas stream from said path into said passageway for movement from said gas inlet to said gas and fine particles outlet, thereby bypassing said separating zone and varying the fineness of fine particles entrained in said stream of gas; collector means in communication with said housing for collecting fine particles discharged from said housing; and sensor means for sensing chances in the quantity of fine particles accommodated in said collector means.

2. The construction according to claim 1 including control means for adjusting said diverting means thereby varying said selected portion of said gas.

3. The construction according to claim 1 wherein said passageway is within said housing.

4. The construction according to claim 3 wherein the particulate material introduced into said housing passes through said passageway upstream of said separating zone.

5. The construction according to claim 1 wherein said passageway is external of said housing.

6. The construction according to claim 1 including control means coupled to said adjustable diverting means for adjusting the latter to vary the portion of said gas stream diverted from said path.

7. The construction according to claim 1 including control means coupling said sensor means and said adjustable diverting means for adjusting the latter in response to the sensing by said sensor means of a predetermined change in the quantity of fine particles in said collector means.

8. In a method of separating particulate material into relatively fine and relatively coarse particles wherein the particulate material and a gas stream are introduced independently of each other to a separating zone through which a gas stream flows at such velocity as to entrain fine particles and convey them from said zone, the improvement comprising:

diverting a selected portion of said gas stream from said zone upstream of said zone; and combining the diverted portion of said gas stream with the entrained fine particles downstream of said zone.

9. The method according to claim 8 including passing said particulate material through the diverted portion of said gas stream upstream of said separating zone.

10. The method according to claim 8 including separating the entrained fine particles from said gas stream downstream of said zone.

11. The method according to claim 8 including separating said entrained fine particles from said gas stream following the combining of said diverted portion of said gas stream with said entrained fine particles.

12. The method according to claim 11 including collecting the fine particles following their separation from said gas stream.

13. The method according to claim 12 including monitoring the quantity of collected fine particles.

14. The method according to claim 12 including sensing changes in the quantity of collected fine particles and adjusting the portion of said gas stream diverted from said zone in relation to the sensed changes in the quantity of collected fine particles.

15. The method according to claim 14 including reducing the portion of gas diverted from said gas stream in response to the sensing of a decrease in the quantity of collected fine particles.

16. The method according to claim 14 including increasing the portion of gas diverted from said gas stream in response to the sensing of an increase in the quantity of collected fine particles.

* * * * *